US007989704B2

(12) United States Patent
Bessede et al.

(10) Patent No.: US 7,989,704 B2
(45) Date of Patent: Aug. 2, 2011

(54) ELECTRIC INSULATOR AND A METHOD FOR THE PRODUCTION THEREOF

(75) Inventors: Jean-Luc Bessede, Chateauvillain (FR); Yannick Kieffel, Saint-Jean-de-Bournay (FR)

(73) Assignee: Areva T&D SA, Paris (FR)

( * ) Notice: Subject to any disclaimer, the term of this patent is extended or adjusted under 35 U.S.C. 154(b) by 655 days.

(21) Appl. No.: 11/995,978

(22) PCT Filed: Jul. 20, 2006

(86) PCT No.: PCT/EP2006/064473

§ 371 (c)(1),
(2), (4) Date: Jul. 8, 2008

(87) PCT Pub. No.: WO2007/010025

PCT Pub. Date: Jan. 25, 2007

(65) Prior Publication Data

US 2008/0296046 A1 Dec. 4, 2008

(30) Foreign Application Priority Data

Jul. 20, 2005 (FR) ..... 05 52253

(51) Int. Cl.
*H01B 17/00* (2006.01)

(52) U.S. Cl. ..... 174/139; 174/178; 174/174; 174/141 R; 264/334

(58) Field of Classification Search ..... 174/139, 174/141 R, 178, 179, 174; 264/334
See application file for complete search history.

(56) References Cited

U.S. PATENT DOCUMENTS

| | | | | |
|---|---|---|---|---|
| 3,645,899 | A | 2/1972 | Linson | |
| 4,259,545 | A * | 3/1981 | Hayden | 174/139 |
| 4,810,836 | A * | 3/1989 | Shinoda et al. | 174/139 |
| 4,919,217 | A * | 4/1990 | Mima et al. | 174/139 |
| 5,594,827 | A * | 1/1997 | Joulie et al. | 385/101 |
| 6,048,946 | A | 4/2000 | Beisele | |
| 6,638,567 | B1 | 10/2003 | Beisele | |
| 6,657,128 | B2 | 12/2003 | Ramarge et al. | |

FOREIGN PATENT DOCUMENTS

| | | |
|---|---|---|
| EP | 1 091 365 A1 | 4/2001 |
| GB | 1172048 | 11/1969 |
| GB | 1 233 310 | 5/1971 |

(Continued)

OTHER PUBLICATIONS

"Composite Insulator Handling Guide", Working Group 22.03, Cigré Study Committee 22, No. 184, Apr. 2001, 27 Pages.

(Continued)

*Primary Examiner* — Dhiru R Patel
(74) *Attorney, Agent, or Firm* — Oblon, Spivak, McClelland, Maier & Neustadt, L.L.P.

(57) ABSTRACT

An electrical insulator including a tube surrounded by an insulating sheath. The insulating sheath is composed of a filled, hardened, flexibilized, hydrophobic, cycloaliphatic epoxy resin containing from 25 to 75 percent by weight of mineral filler. The process for manufacturing this insulator includes the steps of installing the insulator tube or a precursor of the tube in an electrical insulator mold, feeding the filled unhardened hydrophobic cycloaliphatic epoxy resin in the mold so as to form the sheath, hardening the resin inserted in the mold so as to obtain the insulator, and extracting the insulator obtained from the mold.

28 Claims, 1 Drawing Sheet

FOREIGN PATENT DOCUMENTS

| | | | |
|---|---|---|---|
| GB | 2 147 225 | A | 5/1985 |
| WO | WO 02/061767 | A1 | 8/2002 |

OTHER PUBLICATIONS

J. T. Burnham, et al., "IEEE Task Force Report: Brittle Fracture in Nonceramic Insulators", IEEE Transactions on Power Delivery, vol. 17, No. 3, Jul. 2002, pp. 848-856.

Christian Beisele, "Hydrophobic Cycloaliphatic Epoxy: Latest Findings and Future Developments", 2001 World Insulator Congress and Exhibition, Nov. 18-21, 2001, pp. 1-13.

* cited by examiner

ELECTRIC INSULATOR AND A METHOD FOR THE PRODUCTION THEREOF

TECHNICAL FIELD

This invention relates to an electrical insulator comprising a tube surrounded by an insulating sheath. The sheath may be smooth or it may be provided with fins. This invention also relates to a process for manufacturing this insulator.

The insulator according to this invention can be used particularly in high and medium voltage outdoors applications, in other words more than 1000 V.

In the remainder of this description, references between brackets ([ ]) refer to the list of references presented at the end of the examples.

PRIOR ART

Polymer-based insulators, particularly for outdoors applications, are made using expensive materials and complex processes. Normal processes make use of a central tube made of resin, for example an epoxy resin, reinforced by fibers, for example glass fibers. The tube provides mechanical strength for the insulator. The outside surface of the tube is covered with a layer of insulating material called the sheath, to provide the required electrical surface properties, for example for high voltage insulators, and to protect the tube from the weather, moisture and electrical arcs at the surface of the insulator. The surface of the insulator is normally provided with a series of fins offering a long leakage distance.

Applications also exist in which the insulator is provided with a smooth sheath, particularly in the case of an insulator intended for indoors use. Throughout this description, the term <<sheath>> refers equally well to a smooth sheath and to a sheath provided with fins. Similarly, the term <<fins>> denotes a sheath composed of fins.

Four main techniques are used to make the sheath of an insulator and its fins: (1) direct molding on the tube, (2) manufacturing of the fins and then attachment of the fins on the tube, (3) formation of a strip and the strip is then wound around the tube, and (4) extrusion of the fins directly onto the tube using a screw shaped mould.

Technique (1) requires formation of a special mould for fins, while techniques (2) to (4) require post-processing to cross-link the fins. For outdoors applications, all techniques (1) to (4) usually make use of silicone-based materials due to their hydrophobicity.

Throughout this description, <<silicone>> or <<silicone rubber>> denotes a composite elastomeric material composed of a single or dual component silicone polymer resin optionally reinforced by a mineral filler.

For example, document EP-A-1091365 [1] describes an insulator composed of an epoxy resin tube reinforced by fibers and surrounded by an insulating protection composed of silicone rubber. This protection may be in the form of fins. The insulator may be obtained by molding of vulcanized silicone rubber on the fiber-reinforced epoxy resin tube. Silicone is used for its hydrophobicity properties and hydrophobicity transfer properties.

However, these insulators include an interface between two different materials in the tube and the fins, which can cause voids and delamination phenomena due to different thermal expansion coefficients, and can cause partial discharges and consequently flashovers when these insulators are in use.

The only way to reinforce adhesion at the interface between the material from which the hollow tube is made and the material from which the fins are made, is to use an adhesion primer. Materials and manufacturing costs are high. The silicone rubber used is an expensive material. These processes are complex and they include a large number of manufacturing steps to obtain an insulator.

Document WO 02/061767 [2] describes a housing for an electrical appliance. This housing comprises a tube called a sheath, at least one fin, and a hydrophobic coating on the fin. The tube is composed of high temperature vulcanizing (HTV) silicone, the silicone fin is composed of a Room Temperature Vulcanizing (RTV) silicone, and the hydrophobic coating is made of liquid silicone (LS) rubber, and RTV silicon. Liquid silicone is worked by molding, and solid silicone is worked by extrusion.

Materials used for this insulator are also expensive and the manufacturing process is complicated.

Thus, insulator manufacturers according to prior art recommend the use of different materials for the tube and the sheath, due to their function and their different fillers applied during the use of the insulator. Furthermore, at the moment, silicone is the material normally and preferably used to make this type of insulator.

There are many disadvantages related to the use of silicone. The major disadvantage is the modification to the mechanical properties of silicone under the effects of weathering and UV radiation. This material becomes brittle and the fins can crack or break in service. Similarly, the brittleness of the material makes maintenance operations on site very difficult: any false maneuver can cause damage to the fins and therefore to the insulator.

It is particularly difficult to handle these insulators with silicone fins. The fins can be easily damaged during reception of the insulators in the factory when the packaging is being cut with a cutter: insulators with cut or lacerated fins are often found.

Typical problems with composite insulators, relating to handling or resistance over time, are dealt with particularly well in the CIGRE theme leaflet No. 184 April 2001 <<Composite Insulator Handling Guide>> and in the <<IEEE Task Force Report: Brittle Fracture in Nonceramic Insulators>> publication, IEEE Transactions on Power Delivery, Vol 17, No. 3, July 2002, pp 848-856 [3].

Any defect in the fins will be a point of weakness for the long term resistance of the insulator. Similarly, fins may be torn when the insulator is bearing on a part with an edge.

Furthermore, during use, it has been observed that silicone may be attacked by animals such as birds or rodents.

The document <<Hydrophobic cycloaliphatic epoxy: Latest findings and future developments>>, Christian Beisele, 2001 World Insulator Congress and Exhibition, 18-21 November, Shanghai, CHINA [4] describes the replacement of silicone by a cycloaliphatic epoxy resin for the manufacture of insulating components for the first time, particularly for insulators with a solid tube. Epoxy resin is presented as being an attractive and less expensive alternative insulating material. The insulator is made by a high pressure gelation process. The process is not described in detail.

Resins used in this document do not overcome all the drawbacks mentioned above: they have poor resistance to external aggression during operation (rodents, birds, rain, pollution, etc.), to tracking and erosion (resin class 1B3.5 according to IEC standard 60587). Furthermore, they have poor resistance to manipulations in the factory, assembly on site, and they can be cut or torn when opening packages. The mechanical properties of these materials are similar to silicone. Thus, the same problems can be expected during manufacturing, assembly and use of an insulator and while in operation.

None of the above mentioned documents proposes a solution to all of the disadvantages mentioned above.

Therefore, there is a real need for an insulator less expensive than in prior art, both in terms of materials used for manufacturing and for use of its manufacturing process, with an improved behavior upon ageing, particularly by reinforcing or eliminating the interface between the material from which the tube is made and the material from which the sheath is made, and using one or more materials that overcome the disadvantages mentioned above and fulfill their insulating role in the insulator obtained.

SUMMARY OF THE INVENTION

This invention relates specifically to an electrical insulator that satisfies this and other needs. The electrical insulator according to this invention comprises a hollow or solid tube surrounded by an insulating sheath. The insulating sheath may be smooth or provided with fins.

The insulator according to this invention is characterized in that the insulating sheath is composed of a filled, hydrophobic cycloaliphatic epoxy resin made flexible (flexibilized) and hardened, obtained by hardening a mix comprising: 25 to 75% by weight of mineral filler, preferably 30 to 70% by weight of mineral filler, preferably 40 to 60% by weight of mineral filler, and more preferably 45 to 55% by weight of mineral filler, for example 50% by weight, a hydrophobic cycloaliphatic epoxy resin and a hardener.

Herein, percentages by weight are indicated with reference to the total mass of the filled resin, in other words resin+hardener+filler.

In the remainder of this description, a <<filled resin>> means a composite material composed of an epoxy resin, a hardener and a mineral filler. The role of the mineral filler is to improve the mechanical properties of the hardened resin and its resistance to erosion and electrical tracking.

The filled, hardened resin of the present invention is a so-called <<flexibilised>> resin. Therefore, once polymerised this resin has special mechanical properties such as very high elastic modulus and deformation at failure, e.g. an elastic modulus ranging from 200 to 4000 MPa and deformation at break ranging from 10 to 30%. This filled, hardened resin is generally obtained by mixing a basic resin, which may be specially formulated so that on completion of the hardening process, a flexibilised hardened resin is obtained, with hardener(s) specially formulated to obtain a flexibilised, hardened resin, and possibly with additives such as flexibilisers (these two even three elements chemically reacting together, allowing a flexibilised, hardened resin to be obtained), and mineral fillers.

The terms <<flexibilised resin>> are terms frequently used in this technical area and whose meaning is fully clear and unambiguous for those skilled in the art. Flexibilisation of resins can be obtained by chemically modifying molecules of a hardener and potentially of a resin, and/or potentially by incorporating a flexibiliser (flexible chains such as aliphatic chains) during polymerisation.

A flexibilised resin can have a reduced cross-linking rate compared with said resin before any flexibilising treatment.

Generally, the flexibilising of a hardened resin is chiefly obtained through modification of the cycloaliphatic hardener, by spacing apart the two reactive aliphatic cycles through the insertion of an aliphatic chain.

Advantageously, the filled, hardened, flexibilized cycloaliphatic epoxy resin according to this invention, or the filled resin, has a modulus of elasticity of 200 to 4000 MPa and resistance to tracking and erosion equal to or greater than class 1A3.5 or 1B3.5, according to IEC (International Electronic Commission) standard 60587.

Preferably, the filled, hardened, flexibilised hydrophobic cycloaliphatic epoxy resin used in this invention has Shore A hardness of more than 98, and/or a glass transition temperature of 0 to 50° C., preferably 10 to 30° C., further preferably of 18 to 30° C., and/or a modulus of elasticity of 200 to 4000 MPa, and/or an elongation at break from 10 to 30%, and/or an ultimate strength of 14 to 40 MPa, and/or a resistance to tracking and erosion equal to or greater than class 1A3.5 or 1B3.5 according to IEC standard 60587.

The solution provided by this invention to the various drawbacks mentioned above consists of using this filled, hardened, flexibilized hydrophobic cycloaliphatic resin for which the mechanical properties are compared with materials according to prior art in table I below.

TABLE I

| | Document [4] | | Epoxy resin filled, hardened | | Filled hardened, flexibilised hydrophobic cyclo-aliphatic |
|---|---|---|---|---|---|
| | LMB5727/5728 | LMB5729/5730 | non-flexibilised (typical values) | Silicone (typical values) | expoxy resin according to this invention |
| Shore hardness A | 89 | 97 | >95 | 30-80 | >98 |
| Breaking strain (MPa) | 3 | 6 | >60 | 5-8 | 15-40 |
| Elongation at break (%) | 60 | 65 | ~1 | >100 | 10-30 |
| Modulus of elasticity (MPa) | 24 | 53 | >10000 | <50 | 200-4000 |
| Resistance to tracking and erosion | 1B3.5 | 1B3.5 | >1B3.5 | 1B4.5 | −1B4.5 |

According to the invention, the mineral filler preferably comprises 25 to 75% by weight of alumina trihydrate (ATH) ($Al(OH)_3$), preferably 40 to 60% by weight, for example 50% by weight, the remainder being composed of at least one other mineral filler material.

According to the invention, the other mineral filler material may advantageously be chosen from the group comprising alumina ($Al_2O_3$), silica ($SiO_2$), calcium oxide (CaO), magnesium oxide (MgO), zinc oxide (ZnO), silicon fluoride, wollastonite, calcium carbonate ($CaCO_3$), titanium oxide ($TiO_2$), nanoparticles of clay or a mix of two or more of these materials.

Preferably, the other mineral filler material is alumina or silica or a mix of alumina and silica. Thus in this case, the mineral filler comprises 25 to 75% by weight of alumina trihydrate, preferably 40 to 60% by weight of alumina trihydrate, for example 50% by weight, the remainder consisting of alumina or silica or a mix of alumina or silica. When a mix of alumina and silica is used, this mix may for example be composed of 1 to 99% by weight of alumina, for example 5 to 95% by weight of alumina, for example 30 to 70% by weight of alumina, the remainder being silica.

According to the invention, the mineral filler is preferably composed of particles with different size grading: particles of one or several chemical types among those mentioned above (mineral filler) with submicronic size and particles of one or several chemical types among those mentioned above (mineral filler) with micronic size, these reinforcement particles with distinct sizes possibly having exactly the same or a different chemical composition. Thus according to the invention, the mineral filler may be a mix of a micronic sized filler and a submicronic sized filler. Furthermore according to the invention, micronic sized particles may have several different chemical compositions, in the same way, submicronic sized particles may have several different chemical compositions.

Advantageously, submicronic particles are not more than half as large as micronic particles.

Note that the concept of size is related to the <<median diameter>> of the particle distribution, if the geometry of the particles used resembles a spherical geometry. Remember that the <<median diameter>> is the particle diameter at the median of the particle diameter distribution, the median being defined such that the total frequencies of values above and below the median are identical. If the morphologies of the particles used are such that they have higher shape factors, for example lamellar morphologies such as sheets or sticks, the concept of size is related to the largest dimension of the particle, for example the length in the case of a foil.

Note that the size of submicronic particles is less than or equal to 1 micrometer, and the size of micronic particles is more than 1 micrometer.

Advantageously according to the invention, the size of submicronic particles is between 1 and 30 micrometers and the size of micronic particles is less than 1 micrometer.

Advantageously according to the invention, the size of submicronic particles is a few hundred nanometers and at least 5 nanometers.

Preferably, particles in the mineral filler(s) are chemically treated on the surface to improve wetting and bond with epoxy resin. Preferably, silica is modified by silanization.

According to the invention, the mix which, after hardening, allows the obtaining of a filled, hardened, flexibilised, hydrophobic cycloaliphatic epoxy resin, comprises a basic epoxy resin of non-modified, hydrophobic, cycloaliphatic type.

According to the invention, said mix also comprises a hardener. Any cycloaliphatic epoxy resin hardener known to those skilled in the art can be used to implement this invention. For example, it could be a cycloaliphatic anhydride. The quantity of this hardener is usually 60 to 100% by weight as a ratio of the total mass of the unfilled resin used in this invention.

As mentioned above, the hardener may be chemically modified to flexibilise the resin once hardened. This component being known as a flexibilising hardener.

According to the invention, said mix may comprise chemical additives including flexibilisers, accelerators, one or more specific additives to make the resin hydrophobic chosen from among a polysiloxane with —OH endings, a polysiloxane/polyether copolymer and a cyclic polysiloxane or a mix of two or three of these polysiloxanes.

According to the invention, said mix may also comprise elastomeric spheres. In this case, a quantity of 5 by 10% of elastomeric spheres is added. Obviously, this percentage is expressed with respect to the weight of the filled hydrophobic cycloaliphatic epoxy resin. These spheres can absorb the energy of impacts applied to the insulator. For example, they could be Durastrength Impact Modifier (trademark) spheres marketed by the Arkema company.

According to the invention, said mix can also comprise one or several additives, chosen from among a polysiloxane with —OH terminations, a polysiloxane/polyether copolymer and a cyclic polysiloxane or a mix of two or three of these polysiloxanes. More precisely, it may for example be dodecamethylcyclohexasiloxane. The quantity of this (these) additive (s) is usually 1 to 10% by weight as a ratio of the total weight of the filled resin used in this invention.

According to the invention, the mineral filler is preferably dried and degassed before it is mixed with the epoxy resin to form the hydrophobic cycloaliphatic epoxy resin used in this invention. This can improve dispersion of the filler in the resin so that a homogenous mix can be obtained. This drying and degassing can be done simultaneously, for example by placing the mineral filler under a vacuum at a temperature of 70 to 100° C., for example during 10 to 30 hours.

The filled, hardened, flexibilised, hydrophobic, cycloaliphatic epoxy resin used in this invention may be prepared by making a simple mix of the unhardened resin, the filler and the hardener and any additives. Obviously, this mix is preferably made so as to obtain a uniform mix, in other words a homogeneous dispersion of the mineral filler and the hardener and any additives in the resin.

Advantageously, part of the mineral filler, preferably dried and degassed, is mixed with liquid (in other words unhardened) resin, another part of the mineral filler, preferably dried and degassed, is mixed with the liquid hardener, and the two mixes obtained are mixed together to form a filled resin that can be used in this invention. This implementation enables good homogenization. Preferably, each mix is made at a temperature of 40 to 60° C. and is degassed. Mixes may be done mechanically, for example by kneading.

The insulator according to this invention also includes a tube. According to the invention, the insulator tube may be a solid tube or a hollow tube. It is the source of the insulator's mechanical strength. It may be flexible or rigid, and is preferably rigid.

Regardless of whether it is solid or hollow, the geometry of the tube according to the invention is not limited to any particular shape. It is chosen particularly as a function of the application considered. For example, it may be a straight tube, a conical tube, a tapered tube, a barrel-shaped tube, etc., or a tube with a combination of these different shapes or geometries. The tube is usually straight, or conical or tapered or is in the shape of a barrel.

According to the invention, the section of the tube is not limited to a particular geometry. It is chosen particularly as a function of the envisaged application. In particular, it is usually round but it may also be square, triangular, polygonal, for example with 5 to 30 sides. Ease of manufacturing may also be a criterion for choosing the geometry and cross-section of the tube.

According to the invention, the tube (solid or hollow) may for example be a tube made of a thermosetting or thermoplastic polymer resin reinforced by short or long fibers with a mineral or organic chemical nature. Short fibers means fibers with an average length of less than 30 mm. Long fibers means fibers with an average length of more than 30 mm. If a tube is made composed of a thermosetting or thermoplastic resin reinforced by short fibers, the tube is made by injection. Injection points are defined so as to obtain a good alignment of fibers parallel to the axis of the tube.

According to the invention, whether the tube is solid or hollow, it may advantageously be composed of an arrangement of fibers in the shape of a tube. These fibers may be long or short. For example, the arrangement of the fibers may be formed by filamentary winding of long fibers or from short fibers.

If a fiber arrangement is used, the fibers may advantageously be composed of an arrangement of fibers chosen from among a mat of fibers or a fabric of single-dimensional, two-dimensional or three-dimensional fibers. The fiber arrangement may be either woven or non-woven.

Regardless of the fiber arrangement chosen, fibers according to the invention are preferably chosen from among mineral fibers such as glass fibers, quartz fibers, silicon carbide fibers, or from among organic fibers such as aramide fibers such as Kevlar (trademark), polyester fibers, and polybenzobisoxazole fibers, for example Zylon (trademark).

According to the invention, fibers in the arrangement are preferably impregnated with an epoxy resin, and further preferably with a cycloaliphatic epoxy resin, for example a filled, hydrophobic cycloaliphatic epoxy resin via a special organic or inorganic reinforcement (such as alumina, silica or a mix of the two) according to this invention as defined above. For example, the arrangement of fibres is impregnated with hydrophobic, cycloaliphatic epoxy resin containing 25 to 75 wt. % of mineral filler and a hardener.

A special surface treatment may have been carried out on fibers, and more particularly mineral fibers, to improve their compatibility with the impregnation resin, particularly wettability of the resin on the fibers. Therefore the arrangement of fibers forms a precursor of the tube and the insulator according to this invention.

According to the invention, the tube (solid or hollow) can, for example, be a tube in thermoplastic or thermosetting polymeric resin reinforced with an inorganic or organic filler, e.g. a tube in epoxy resin reinforced with alumina or silica.

This invention relates particularly to the use of a filled, hardened, flexibilised hydrophobic cycloaliphatic epoxy resin obtained by hardening a mix 25 to 75 wt. % of mineral filler, preferably 30 to 70 wt. % of mineral filler, preferably 40 to 60 wt. % of a mineral filler, more preferably 45 to 55 wt. % of a mineral filler, for example 50 wt. %, a hydrophobic cycloaliphatic epoxy resin and a hardener for manufacturing an electrical insulator, particularly for manufacturing the outside sheath of an insulator, this sheath possibly but not necessarily being provided with fins. In this use, the filled, hardened, flexibilised, hydrophobic cycloaliphatic epoxy resin has the same properties as those obtained above.

This use will simplify processes according to prior art and solve the above-mentioned disadvantages. The mineral filler improves the resistance to tracking and erosion of the material.

As mentioned above, according to the invention, the filled resin may be used to make the sheath of the insulator only, with or without fins, for example in replacement of silicone-based materials according to prior art, or to make the tube, the sheath and the fins of the insulator, for example when the tube is composed of an arrangement of fibers.

If the sheath is provided with fins, this invention may for example consist of molding the said fins on a tube, the tube for example possibly being composed of an arrangement of fibers reinforced by an epoxy resin identical to or different from that used for the sheath, and possibly but not necessarily provided with fins. For example, the tube may be composed of fibers reinforced by an epoxy resin like that described and obtained in document [1].

For example, this invention can also be used in a process for manufacturing an electrical insulator comprising a solid or hollow tube surrounded by an insulating sheath, said sheath possibly being provided with fins, characterized in that it comprises the following steps:

- install the insulator tube, or when the tube is a hollow tube, install a precursor of said tube optionally composed of an arrangement of fibers forming a tube, in an electrical insulator mould, possibly with fins,
- feed (insert) in the mould a mix comprising: 25 to 75% by weight of a mineral filler, a hydrophobic cycloaliphatic epoxy resin and a hardener so as to form the sheath and possibly its fins, around said tube or its precursor,
- harden the mix fed (inserted) into the mould so as to obtain a filled, hardened, flexibilised hydrophobic cycloaliphatic epoxy resin, thereby obtaining the insulator, and
- extract the insulator obtained from the mould.

According to a first embodiment of the process according to this invention, a precursor of the tube is used, this precursor being composed of an arrangement of fibers like that described above. In this embodiment, the precursor (arrangement of fibers) is placed in the mould, the said arrangement of fibers being impregnated with the filled resin during the step to add the said resin into the mould to form the resin of the tube after hardening. In this case, the filled resin forms the tube and the fins of the insulator. In this case, a sleeve is preferably placed in the tube formed by the arrangement of fibers so that the resin does not fill the hollow tube.

According to a second embodiment of this invention, the tube used is a resin tube reinforced by an arrangement of short or long, inorganic or organic fibers. The resin is identical to or different from the filled resin used to form the sheath and the fins. For example, it may be a CEVOLIT (trademark) tube made by the Tyco Electronics Energy company. It may for example be a tube like that described in document [1]. This tube may for example be made as described in this document, and can then be used in the process according to this invention to fabricate the insulator.

The materials that can be used in these processes and the mix are described below.

According to the invention, the ribbed electrical insulator mould is preferably made from a metallic material, preferably stainless steel. It is preferably cylindrical and its shape defines the fins of the insulator. More generally, it may be of any required geometric shape, for example cylindrical, conical, tapered or barrel-shaped, or it may be of any other advantageous shape for its use, in the same way as the shape of the tube.

Such moulds can be manufactured by in-depth machining of stainless steel using precision instruments, such as digital milling and digital grinding machines. An electro-erosion, chemical polishing or even mechanical polishing type of surface treatment can improve the quality of the mould surface, and consequently the surface quality of the insulator (low surface roughness). These moulds may be designed and made by companies such as Techni-moules, REP France or FAMACOM.

Advantageously, according to the invention, a silicone-based mould removal agent can be used to facilitate removal of the insulator from its mould. In particular, mould removal agent L 94-700 (trade reference) made by the Kluber Chemie company can be used.

According to the invention, the mix is injected into the mould by any appropriate means for filling it. Preferably, the mix is injected into the mould under pressure, for example using an injection press of the same type as that used to inject silicone when manufacturing insulators according to prior art. Preferably, the mix is injected hot, so that it is easier to match the shape of the mould, for example at a temperature of 100 to 140° C. Preferably, the mould is heated to this temperature for the same reasons, while the resin is being injected.

Advantageously, the mix is injected at several points along the insulator.

The solid or hollow tube, for example a hollow tube based on epoxy resin reinforced by long glass fibers, is previously arranged in the mould, and is preferably kept at the same temperature as the mould (for example 130-140° C.) in order to get good bond between the resin and the tube. The tube is preferably longer than the mould, and projects on both sides of the mould.

Advantageously, the mix is kept at its polymerization temperature, usually from 120 to 140° C., for example for 4 to 10 hours.

After the mix has hardened, the insulator obtained is removed from the mould.

According to the invention, the insulator can be post-baked, for example at a temperature of 130 to 150° C., for example for 6 to 10 hours in order to obtain optimum mechanical properties of the resin.

The insulator obtained may be subjected to a finishing treatment. In this treatment, the hollow tube may be cut to the final length of the insulator if it is too long. Traces of molding such as burrs at the mould joint may be eliminated mechanically, for example by mechanical polishing.

Finally, one or two metallic collars may be fixed traditionally, for example by gluing at one or both ends of the insulator, for example using an epoxy glue. In particular, the sintering technique is used in which the metallic collar is expanded by heating so that the previously glued tube can be forcefully inserted in the previously glued collar. Shrinkage of the metallic collar on the composite tube assures good adhesion of the collar onto the tube. This adhesion is reinforced by glue.

Thus according to the invention, the process may also include a step to glue one or two collars to one or to both ends of the electrical insulator. For example, this is the case when the fabricated insulator is a support insulator.

Two metallic collars may be fixed using the process described above in the case of a support insulator to be fixed at these two ends.

A single metallic collar is fixed using the process described above for an insulator used as a simple support. In this configuration, the other end can be machined so that the high potential conductor can be connected to it. Machining may be done in the form of a notch in the case of a bar support or the tube may be drilled so that a conductor can be passed through it.

The insulator according to this invention, for example a solid tube or a composite/glass fabric tube may be cylindrical, conical, barrel shaped or any other useful shape for use.

This invention has the following advantages in particular:

- Due to the materials and the process used, it can be used to make an insulator less expensive than insulators according to the prior art,
- Due to the materials used, it can be used to make an insulator with a longer life and with better reliability under severe usage conditions (rain, pollution, birds, rodents, etc.) than insulators according to prior art,
- The insulator does not have a free interface between the hollow tube and the fins because an epoxy resin is used for the tube and for the fins (identical or different),
- The insulator does not have any problem of voids and delaminations at the fin/tube interface, which also improves its life and assures greater reliability under severe usage conditions (rain, pollution, birds, rodents, etc.), than insulators according to the prior art, with no partial discharges or flashover at this point (namely the fin/tube interface).
- It can eliminate the bond primer used in the prior art to reinforce adhesion at the interface between the material of the hollow body and the material from which the fins are made.

Other characteristics and special features of the invention will become clearer after reading the following examples, obviously given as illustrative and non-limitative examples.

EXAMPLES

Example 1

Figure 1:
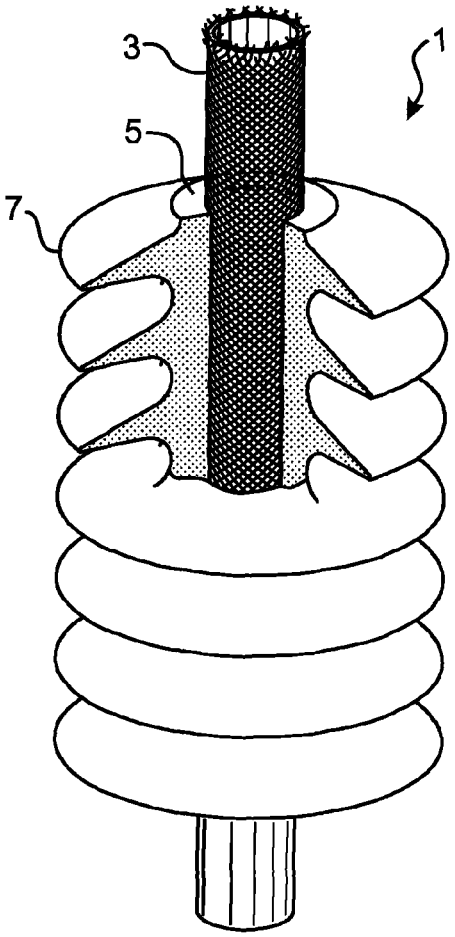
FIG. 1: schematic representation of a hollow tube insulator according to the invention.

Fabrication of a Hollow Tube Insulator According to the Invention

A. Mould and Precursor for Hollow Tube

The mould used is a cylindrical shape and it defines the fins of the insulator. It is made of steel. The mould is composed of two adjacent shells, each defining the internal shape of a half-insulator along the length direction. Thus, the ribbed insulator can be removed from its mould simply by separating the two shells.

A hollow epoxy resin based cylindrical composite tube reinforced by glass fibers (in the form of a glass fiber fabric) is arranged along the longitudinal axis of the mould, and is centered. The composite tube is longer than the mould, and it projects on each side of the mould.

B. Preparation of the Filled Resin

A flexibilized hydrophobic cycloaliphatic epoxy resin is prepared comprising 50% by weight of mineral filler.

First Step: Preparation of the Filler:

The mineral filler, composed of 50% by weight of silica and 50% by weight of alumina trihydrate (ATH) is dried under a vacuum at 80° C. for 24 hours.

Second Step: Preparation of the Resin and the Hardener:

A proportion of the mineral filler, 15 parts by weight, previously dried and degassed, is incorporated into a diglycidilester type liquid cycloaliphatic resin (100 parts by weight) with a specific gravity of 1.1. The specific gravity of the mix thus obtained is 1.2. It is mechanically kneaded at a temperature between 40° C. and 60° C. and is degassed under a vacuum at an absolute pressure between 1000 and 10000 Pa (between 10 and 100 mbars). The result is a resin+filler by-product.

The complement of the mineral filler, in other words the remaining 35 parts by weight, is incorporated into a liquid cycloalipathic anhydride hardener (100 parts by weight). The specific gravity of the mix thus obtained is of the order of 1.9.

It is mechanically kneaded at a temperature between 40 and 60° C. and is degassed as described above. The result is a hardener+filler by-product.

The two by-products, the resin+filler and hardener+filler are mixed together mechanically until a homogenous dispersion is obtained. Mixing is done at a temperature between 40 and 60° C. and degassing is done as above.

The mix obtained is ready for use to mould the insulator.

C. Feeding, Adding, the Resin into the Mould

The mix previously obtained is injected under pressure into the two-part mould previously heated to the polymerization temperature of the resin, in this case between 130° C. and 140° C., using a standard silicone injection press. The temperature is uniform throughout the mould. The hollow composite tube is kept at the mould temperature (120-130° C.) to obtain good adhesion of the resin on the composite tube.

The resin is injected at several points along the insulator so that the fins defined by the mould are well filled.

D. Hardening, Curing, of the Resin

The resin is held at a temperature of 130-140° C. for 20-30 minutes so that it can be hardened, cured.

E. Extract the Insulator from the Mould

The hollow tube insulator (1) is extracted from the mould after the resin has hardened, by opening the mould. It is represented diagrammatically on FIG. 1 appended. It comprises a tube (3) surrounded by an insulating sheath (5) provided with fins (7). The insulating sheath and the fins are composed of the flexibilized hydrophobic filled cycloaliphatic epoxy resin prepared in this example. The tube (3) is composed of a glass fiber fabric reinforced by epoxy resin.

The insulator is post-baked at 140° C. for 8 hours to optimize the mechanical properties of the resin.

The following table contains the properties of the resin obtained.

The hollow tube is then cut to the final length of the insulator.

Moulding traces such as burrs at the mould joint are eliminated by polishing.

One or two metallic collars are then fixed traditionally by gluing at both ends of the insulator. The number of metallic collars depends on the application of the insulator. Similarly, one end can be machined to support a conductor.

The insulator obtained can be used in a high voltage application.

Another test is carried out in which the mineral filler includes 25% by weight of alumina trihydrate (ATH) and 25% by weight of silica. An electric insulator is obtained that can be used in a high voltage application.

Table of properties of the filled, flexibilized hydrophobic resin obtained in this example

| Properties | Unit | Standard | Value |
|---|---|---|---|
| Total filler content (by weight) | % | | 50 |
| ATH filler content (by weight) | % | | 25 |
| Gel time at 110° C. | | | 8'20" |
| Hardness | Shore A | DIN53505 | 99 |
| Glass transition temperature (DSC) | ° C. | ISO11457-2 | 18-30 |
| Tensile strength at 23° C. | MPa | ISO 527 | 17 |
| Elongation at break at 23° C. | % | ISO527 | 19.4 |
| Modulus of elasticity in tension at 23° C. | MPa | ISO527 | 1175 |
| Tensile strength at −25° C. | MPa | ISO527 | 45 |
| Elongation at break at −25° C. | % | ISO527 | 1.5 |
| Modulus of elasticity in tension at −25° C. | MPa | ISO527 | 7764 |
| Dielectric strength | kW/mm | IEC 60243 | 23 |
| Arc resistance | s | IEC 61621/ ASTM D495 | 220 |
| Resistance to tracking and erosion | | IEC 60587 | 1 B4.5 |

(Measurements made on the hardened filled resin)

Example 2

Process for Manufacturing a Solid Tube Insulator According to the Invention

The protocol described in example 1 is used for fabrication of the filled resin and the insulator, but the hollow tube is replaced by a solid tube.

Figure 2:
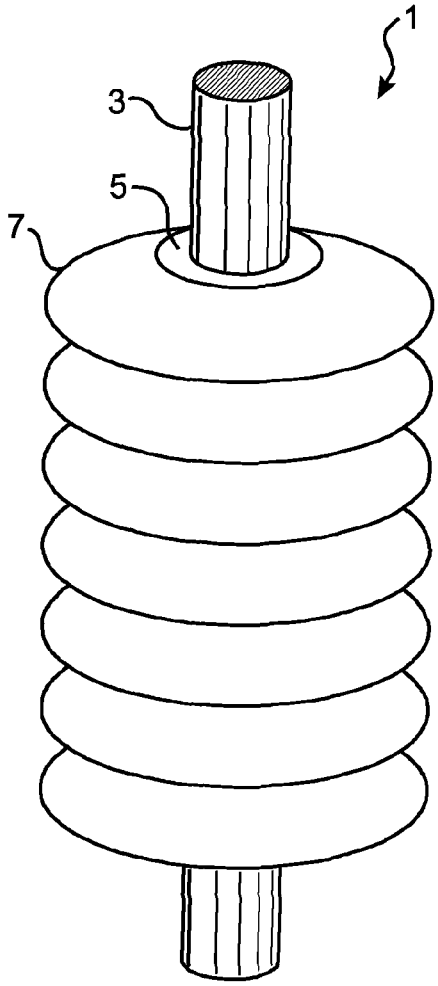
FIG. 2: schematic representation of a solid tube insulator according to the invention.

The result obtained is an electric insulator (1) complying with this invention. This insulator is shown on FIG. 2 appended. It comprises the solid tube (3') surrounded by an insulating sheath (5) fitted with fins (7).

The insulating sheath and the fins are composed of the prepared filled flexibilized hydrophobic cycloaliphatic epoxy resin.

The tube (3') is a rod composed of epoxy resin reinforced by an arrangement of glass fibers.

For example, this insulator could be used in overhead high voltage line supports.

LIST OF REFERENCES

[1] EP-A-1091365 (Axicom A G, Zeigniederlassung Wohlen).

[2] WO 02/061767 (MC-GRAW-EDISON COMPANY).

[3] CIGRE No. 184 April 2001 <<Composite Insulator Handling Guide>> or in the following publication: <<IEEE Task Force Report: Brittle Fracture in Nonceramic Insulators>>, IEEE Transactions on Power Delivery, Vol 17, No 3, July 2002, pp 848-856.

[4]<<Hydrophobic cycloaliphatic epoxy: Latest findings and future developments>>, Christian Beisele, 2001 World Insulator Congress and Exhibition, 18-21 November, Shanghai, CHINA.

The invention claimed is:

1. An electrical insulator comprising:

a solid or hollow tube surrounded by an insulating sheath, wherein the insulating sheath is composed of a filled, hardened, flexibilised, hydrophobic cycloaliphatic epoxy resin including a mix of 25 to 75 percent by weight of a mineral filler, a hydrophobic cycloaliphatic epoxy resin and a hardener, wherein the filled, hardened, flexibilised, hydrophobic cycloaliphatic epoxy resin has the following properties:

a glass transition temperature of 0 to 50 degrees Celsius;

ultimate strength of 14 to 40 megapascals, modulus of elasticity of 200 to 4000 megapascals, elongation at break of 10 to 30 percent, and SHORE A hardness equal to or greater than 98.

2. The electrical insulator according to claim 1, wherein the mix contains 30 to 70 percent by weight of the mineral filler.

3. The electrical insulator according to claim 1, wherein the mineral filler comprises 25 to 75 percent by weight of alumina trihydrate, a remainder being composed of at least one other mineral filler material.

4. The electrical insulator according to claim 3, wherein the other mineral filler material is alumina, silica, calcium oxide, magnesium oxide, silicon fluoride, wollastonite, calcium carbonate, titanium oxide, nanoparticles of clay, or a mix of two or more of these materials.

5. The electrical insulator according to claim 1, wherein the mineral filler comprises 25 to 75 percent by weight of alumina trihydrate, a remainder being composed of alumina or silica or a mix of alumina and silica.

6. The electrical insulator according to claim 1, wherein the mineral filler is a mix of a micronic sized filler and a submicronic sized filler.

7. The electrical insulator according to claim 1, wherein the mix further comprises from 5 to 10 percent by weight of elastomeric spheres.

8. The electrical insulator according to claim 1, wherein the mix further comprises polysiloxane with hydroxide (—OH) terminations, a polysiloxane/polyether copolymer, a cyclic polysiloxane or a mix of two or three of these polysiloxanes.

9. The electrical insulator according to claim 1, wherein the solid or hollow tube is composed of an arrangement of fibers in a form of a tube.

10. The electrical insulator according to claim 9, wherein the arrangement of fibers is composed of a mat of fibers or a fabric of single-dimensional, two-dimensional or three-dimensional fibers.

11. The electrical insulator according to claim 9, wherein the arrangement of fibers is impregnated with a hydrophobic cycloaliphatic epoxy resin comprising 25 to 75 percent by weight of the mineral filler and the hardener.

12. The electrical insulator according to claim 11, wherein the fibers mineral fibers, glass fibers, quartz fibers, silicon carbide fibers, organic fibers, aramide fibers, polyester fibers, or polybenzobisoxazole fibers.

13. The electrical insulator as in one of claims 1 to 8, wherein the solid or hollow tube is made from a resin filled with an organic or inorganic reinforcement.

14. The electrical insulator as in one of claims 1 to 8, wherein the solid or hollow tube is made from a resin filled with alumina, silica or a mix of alumina and silica.

15. The electrical insulator according to claim 1, wherein the solid or hollow tube is a straight tube, a conical tube, a tapered tube, a barrel-shaped tube, or a tube with a combination of these shapes.

16. A process for manufacturing an electrical insulator comprising a solid or hollow tube surrounded by an insulating sheath, said process comprising:

installing the solid tube or installing a precursor of the hollow tube in an electrical insulator mould;

feeding a mix, in the electrical insulator mould, comprising 25 to 75 percent by weight of a mineral filler, a hydrophobic cycloaliphatic epoxy resin and a hardener so as to form the insulating sheath that surrounds the solid or hollow tube;

hardening the mix fed into the electrical insulator mould so as to obtain a filled, hardened, flexibilised, hydrophobic cycloaliphatic epoxy resin, and thereby obtaining the electrical insulator; and extract extracting the insulator obtained from the mould, wherein the filled, hardened, flexibilised, hydrophobic cycloaliphatic epoxy resin has the following properties, a glass transition temperature of 0 to 50 degrees Celsius, ultimate strength of 14 to 40 megapascals, modulus of elasticity of 200 to 4000 megapascals, elongation at break of 10 to 30 percent, and SHORE A hardness equal to or greater than 98.

17. The process according to claim 16, wherein the mix contains 30 to 70 percent by weight of the mineral filler.

18. The process according to claim 16, wherein the mineral filler comprises 25 to 75 percent by weight of alumina trihydrate, a remainder being composed of at least one other filler material.

19. The process according to claim 16, wherein the other mineral filler material is alumina, silica, calcium oxide, magnesium oxide, silicon fluoride, wollastonite, calcium carbonate, titanium oxide, nanoparticles of clay or a mix of two or more of these materials.

20. The process according to claim 16, wherein the mineral filler comprises 25 to 75 percent by weight of alumina trihydrate, a remainder being composed of alumina or silica or a mix of alumina and silica.

21. The process according to claim 16, wherein the mineral filler is a mix of a micronic sized filler and a submicronic sized filler.

22. The process according to claim 16, wherein the mix further comprises from 5 to 10 percent by weight of elastomeric spheres.

23. The process according to claim 16, wherein the mix further comprises a polysiloxane with hydroxide (—OH) terminations, a polysiloxane/polyether copolymer, a cyclic polysiloxane, or a mix of two or three of these polysiloxanes.

24. The process according to claim 16, wherein the precursor of the hollow tube is installed in the mould, this precursor being composed of fibers forming the hollow tube, and the fibers are a mat of fibers or a fabric of single-dimensional, two-dimensional or three-dimensional fibers.

25. The process according to claim 24, wherein the fibers are mineral fibers, glass fibers, quartz fibers, silicon carbide fibers, organic fibers, aramide fibers, polyester fibers, or polybenzobisoxazole fibers.

26. The process according to claim 16, wherein the precursor of the hollow tube is installed in the mould, this precursor being composed of fibers forming the hollow tube, and the fibers being impregnated with unhardened hydrophobic cycloaliphatic epoxy resin during the feeding.

27. The process as in any one of claims 16 to 26, wherein the solid or hollow tube is a straight tube, a conical tube, a tapered tube, a barrel-shaped tube, or a tube with a combination of these shapes.

28. The process according to claim 16, further comprising gluing one or two collars to one or to both ends of the electrical insulator.

* * * * *

UNITED STATES PATENT AND TRADEMARK OFFICE

CERTIFICATE OF CORRECTION

PATENT NO. : 7,989,704 B2
APPLICATION NO. : 11/995978
DATED : August 2, 2011
INVENTOR(S) : Jean-Luc Bessede et al.

It is certified that error appears in the above-identified patent and that said Letters Patent is hereby corrected as shown below:

On the title page, Item (86), the Application Filing Date is incorrect. Item (86) should read:

-- (86) PCT No.: PCT/EP2006/064473

§ 371 (c)(1),
(2), (4) Date: Jul. 2, 2008 --

Signed and Sealed this
Twentieth Day of September, 2011

David J. Kappos

David J. Kappos
*Director of the United States Patent and Trademark Office*